US005294119A

United States Patent [19]

Vincent et al.

[11] Patent Number: 5,294,119

[45] Date of Patent: Mar. 15, 1994

[54] VIBRATION-DAMPING DEVICE FOR A GOLF CLUB

[75] Inventors: Benoit Vincent, Annecy le Vieux; Frederic de Fouchier, Annecy, both of France

[73] Assignee: Taylor Made Golf Company, inc., Carlsbad, Calif.

[21] Appl. No.: 951,792

[22] Filed: Sep. 28, 1992

[30] Foreign Application Priority Data

Sep. 27, 1991 [FR] France ..... 91 12152

[51] Int. Cl.[5] ..... A63B 53/10

[52] U.S. Cl. ..... 273/80 B; 273/80 R; 273/DIG. 23

[58] Field of Search ..... 273/80 R, 80 B, 186.2, 273/81 R, 77 R, 77 A, DIG. 23

[56] References Cited

U.S. PATENT DOCUMENTS

| | | | |
|---|---|---|---|
| 1,169,667 | 1/1916 | Meguyer | 273/80 B |
| 1,688,473 | 10/1928 | Sippel | 273/80 B |
| 1,777,822 | 10/1930 | Barrett | 273/81 R |
| 1,968,616 | 7/1934 | Oldham | 273/81 R |
| 2,023,131 | 12/1935 | Gibson | 273/80 B |
| 2,099,319 | 11/1937 | Shaw | 273/81 R |
| 3,764,137 | 10/1973 | Petro | 273/80 B |
| 3,972,529 | 8/1976 | McNeil | 273/80 B |
| 4,023,801 | 5/1977 | Van Auken | 273/DIG. 23 X |
| 4,415,156 | 11/1983 | Jorgensen | 273/77 A |
| 4,725,060 | 2/1988 | Iwanaga | 273/77 A |
| 4,836,545 | 6/1989 | Pompa | 273/80 R X |
| 4,951,953 | 8/1990 | Kim . | |
| 4,979,743 | 12/1990 | Sears | 273/81 R |
| 5,083,780 | 1/1992 | Walton et al. | 273/80 B |

FOREIGN PATENT DOCUMENTS

| | | | |
|---|---|---|---|
| 2-31770 | 2/1990 | Japan . | |
| 499155 | 1/1939 | United Kingdom . | |
| 2053004 | 2/1981 | United Kingdom . | |
| 2053698 | 2/1981 | United Kingdom . | |
| 2146906A | 5/1985 | United Kingdom . | |
| 2226380A | 6/1990 | United Kingdom . | |
| 2227418 | 8/1990 | United Kingdom | 273/77 A |

*Primary Examiner*—Mark S. Graham
*Assistant Examiner*—Sebastiano Passaniti
*Attorney, Agent, or Firm*—Pollock, Vande Sande & Priddy

[57] ABSTRACT

A device for selectively damping golf club vibrations by controlling their frequencies through optimal positioning at the point of maximum deformation energy for the vibration modes excited after impact. The device may be located at either or both of upper and lower intermediate sections of the club shaft, and is constituted by at least one layer of rigid material joined to the shaft surface by an intermediate layer of resilient material.

26 Claims, 7 Drawing Sheets

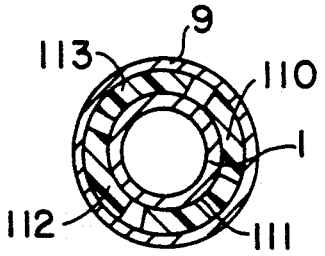
FIG. 15
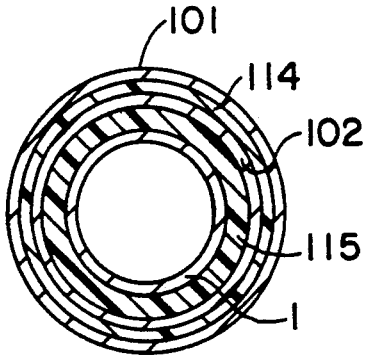
FIG. 16
FIG. 17
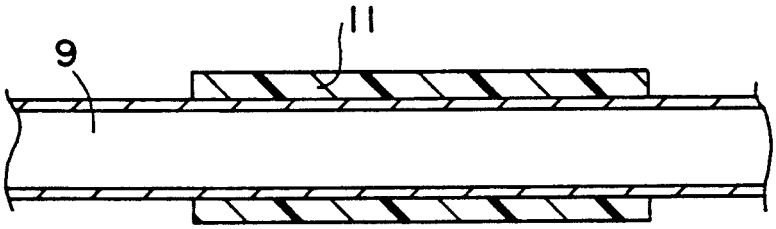
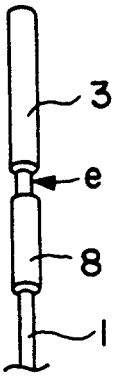
FIG. 18

VIBRATION-DAMPING DEVICE FOR A GOLF CLUB

FIELD OF THE INVENTION

The invention relates to an improvement designed to damp vibratory phenomena in a golf club, and, more specifically, in its shaft. The invention concerns the golf club shaft, as well as the club itself.

BACKGROUND OF THE INVENTION

During the game of golf, the golfer strikes the ball to move it instrument termed a golf club, which is constituted by a shaft, and which incorporates a head at its lower end, and, at its upper end, is equipped with a handle or grip.

To drive the ball into the hole, the golfer uses several types of clubs distinguished by the shapes of their heads used to strike the ball and by the length of their shafts. The impact of the ball on the hitting surface of the club head generates, on the shaft, vibratory phenomena which prove especially unpleasant for the golfer, who, after the impact of the ball, feels discomfort which causes him to lose confidence in his club for the next hit.

An analysis of vibratory phenomena has shown that vibrations in a golf club represent the sum of several elementary vibratory phenomena, or modes, whose frequencies range between 0 and 200 Hertz; i.e., a first, vibratory mode in the plane of the swing, of the "free embedded flection" type for which the frequency is approximately 5 Hertz; a second mode of vibration, of the "supported-embedded flection" type, having a frequency of approximately 50 Hertz; a third, torsional mode of vibration whose frequency is approximately 75 Hertz; and a fourth mode of vibration of the first, harmonic flection type, having a frequency of approximately 130 Hertz. The frequency values depend on the properties of the shaft and head, and on the nature of the boundary conditions (site and gripping intensity). All of these vibrations are felt by the golfer as a disagreeable sensation upon impact, and they thus lessen the confidence the golfer has in the equipment, since he anticipates these unpleasant sensations before hitting the ball. It must be noted that the vibration amplitudes are particularly strong because the speed of the club head at the moment of impact is high and because the strokes are off-center.

Different means for reducing vibration amplitudes are known in the art. Complete elimination or attenuation of bad vibrations deprives the golfer of information feedback. In fact, some manufacturers have incorporated, along the entire length of the shaft and in the structure, fibers, e.g., made of Kelvar, which in the context of use, exhibit well-known damping properties so as to reduce energy and thus the amplitudes of the vibrations; however, damping is not selective and, accordingly, the club damps all modes.

SUMMARY OF THE INVENTION

The present invention seeks to solve the problems of golf clubs according to prior art, by proposing a device designed to damp vibrations selectively in the golf club, by controlling the frequency, or frequencies, to be damped and the amount of damping of each mode of vibration by optimal positioning of the device, i.e., at the point where the energy of deformation is at a maximum for the modes excited after impact.

According to the invention, the damping means are positioned in proximity to the lower end of the club grip and above the neck of the club head.

To this end, the golf club shaft comprising a tubular profile incorporates several parts, i.e., an upper part designed to receive the club grip and extended downward by an upper intermediate section, followed by a central section, then a lower intermediate section, and finally, a lower part designed to be fitted into the club head, and this shaft comprises at least one damping device positioned in the area of at least of these intermediate sections.

According to one embodiment, the golf club shaft comprises a damping device located in the upper intermediate section, and, according to another embodiment, this device is located in the lower intermediate section.

According to another arrangement, the shaft according to the invention incorporates an upper damping device positioned in the upper intermediate section and a lower damping device in the lower intermediate section.

According to one variant, the damping device is positioned on the outer surface of the shaft structure, while, according to another variant, the damping device is placed on the internal surface of the shaft.

According to one advantageous embodiment the damping device comprises a ring made of a rigid material and connected to the golf club shaft by a flexible connector, such as an intermediate layer of a viscoelastic material, which is bonded adhesively both to the rigid ring and to the club shaft.

BRIEF DESCRIPTION OF THE DRAWINGS

Other features and advantages of the invention will emerge from the following description provided with reference to the attached drawings, supplied solely by way of example.

FIG. 3 is a lateral view as seen from F in FIG. 2.

FIG. 11 is a view similar to FIG. 4.

FIG. 12 is a view similar to FIG. 5.

FIG. 13 is a view similar to FIG. 6.

FIG. 15 is a view similar to FIG. 4, illustrating a variant.

FIG. 16 is another variant of the view in FIG. 15.

FIG. 17 is a view similar to FIG. 5, showing a variant.

FIG. 18 is a partial view of a variant.

DESCRIPTION OF THE PREFERRED EMBODIMENTS

Figure 1:
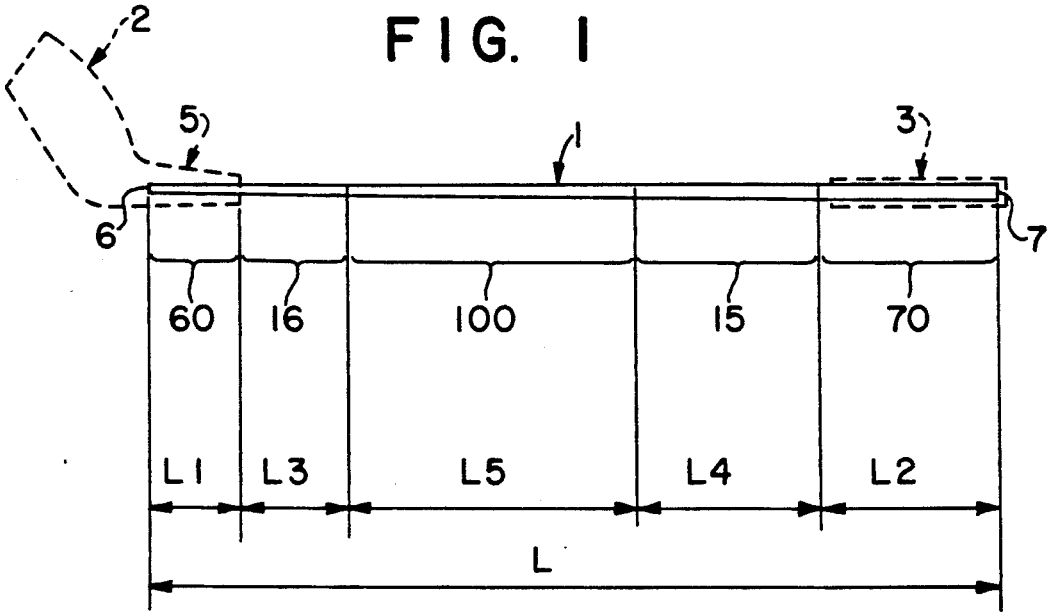
FIG. 1 is a view of a golf club shaft.

FIG. 1 illustrates a golf club shaft 1 constituted by a slightly conical tube larger at its upper end 7 than at its lower end 6, having a length L and made of steel or a composite material. The shaft comprises a lower part 60 having a length L1 and designed to be fitted into the neck 5 of the club head 2, and an upper part 70 inserted in the grip 3 and having a length L2. The central portion 100, having a length L5, is extended downward by a lower intermediate section 16 having a length L3, and upward by an upper intermediate section 15. The lower intermediate section 16 having a length L4 is located just above the flush-fitted lower part 60.

More especially, the upper intermediate section 15 may be specified as having a length L4 measuring approximately 0.2 L, and can be positioned at a distance L2 from the upper end 7 of approximately 0.2 L. Similarly, the lower part 60 and the lower intermediate section 16 have a length L1+L3 of approximately 0.2 L.

According to one of the inventive features, the shaft comprises at least one damping device, which is positioned in one of the intermediate sections.

Figure 2:
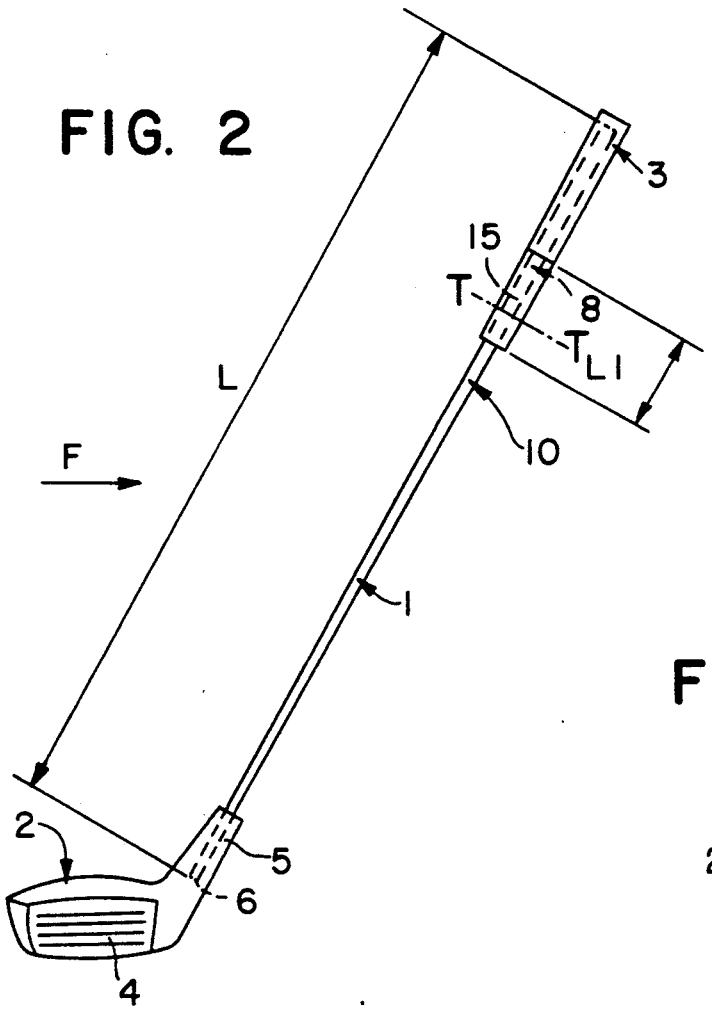
FIGS. 2 and 3 represent a first embodiment of the invention.
Figure 3:
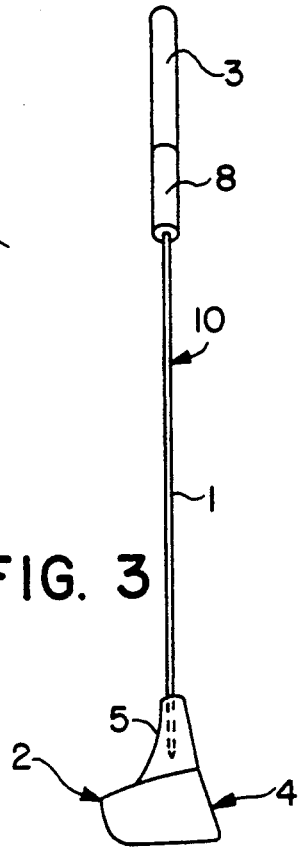
Figure 4:
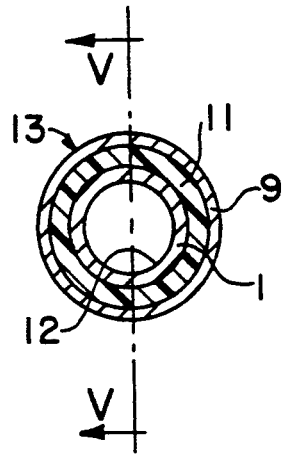
FIG. 4 is an enlarged transverse cross-section along line T—T in FIG. 2.

FIGS. 2 and 3 illustrate a golf club according to one embodiment of the invention. This golf club comprises, in conventional fashion, a shaft 1 which incorporates a head 2 at its lower end, while it comprises a grip 3 at its upper end. These three basic, well-known components will not be described in detail; it will be mentioned only that the head 2 has a hitting surface 4 designed to strike the ball in order to drive it, and a neck 5 in which the lower portion 60 of the shaft 1 is embedded. It should be noted, in addition, that the head may have different shapes depending on the type of golf club, each manufacturer offering similar, but not identical, general shapes for a given type of club. FIGS. 2 and 3 illustrate a type of golf club called a "wood," it being understood that the invention can also be applied to clubs called "irons" and "putters."

According to the invention, the shaft comprises at least one damping device 8 constituted by an outer ring 9 made of a rigid material and joined to the upper surface 10 of the shaft 1 by means of an intermediate layer 11 made of a flexible material, advantageously of the viscoelastic type.

The outer ring 9 is, for example, cylindrical and produced from a metal tube made of aluminum or a Zycral aluminum alloy, or of a composite material, whose draping ensures maximum rigidity and a thickness "e1" ranging from approximately 0.3 to several millimeters, and whose length L1 is, for example, between 1 and 20% of the total length L of the shaft 1, and, advantageously, between 7 and 10%. Accordingly, the length L1 of the ring may be between 70 and 100 millimeters.

As has been previously stated, the intermediate ring 11 is an interface, advantageously made of a viscoelastic material and produced as a layer having a thickness "e2" of between 1 and 4 millimeters.

Thus, the inner surface 12 of the intermediate damping layer 1 is bonded or welded to the outer surface 10 of the shaft, while the outer surface 13 of this intermediate layer is bonded or welded to the inner surface 14 of the outer ring 9.

As shown in FIGS. 2 and 3, the damping device 8 is, according to an additional feature of the invention, positioned on the top part of the shaft in the upper intermediate section 15 located in proximity to the lower end of the grip 3.

Figure 7:
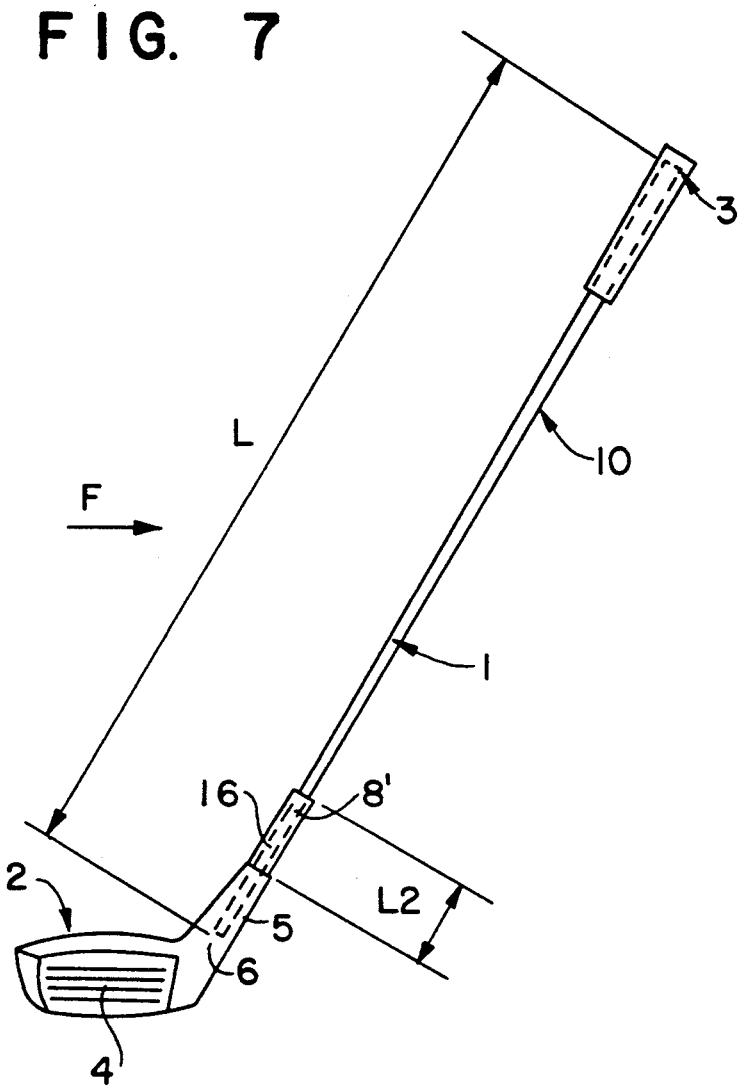
FIGS. 7 and 8 are views similar to those in FIGS. 2 and 3, showing a second embodiment of the invention.
Figure 8:
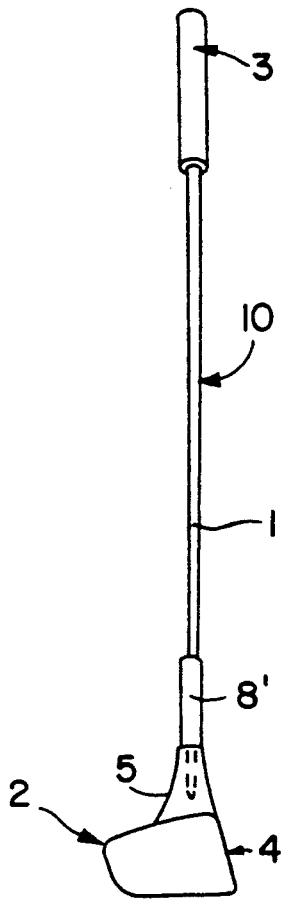

FIGS. 7 and 8 illustrate a variant in which a lower damping device 8', identical to that in FIGS. 2 to 6, is positioned on the bottom of the shaft, in the lower intermediate section 16 located just above the flush-fitting of the shaft in the club head, and, more specifically, just above the neck 5 of this head. In the case of FIG. 7, the length L2 of the damping device is between 1 and 20% of the total length "L" of the shaft, and preferably between 1 and 10%.

Figure 9:
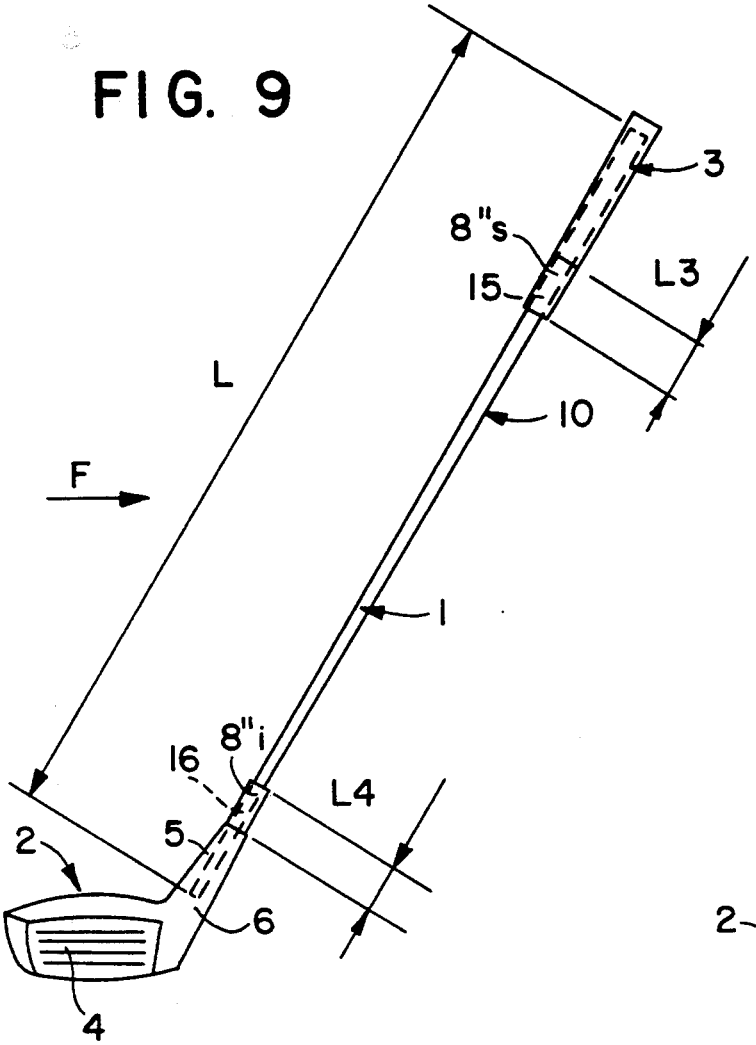
FIGS. 9 and 10 are views similar to those in FIGS. 2 and 3, showing a third embodiment of the invention.
Figure 10:
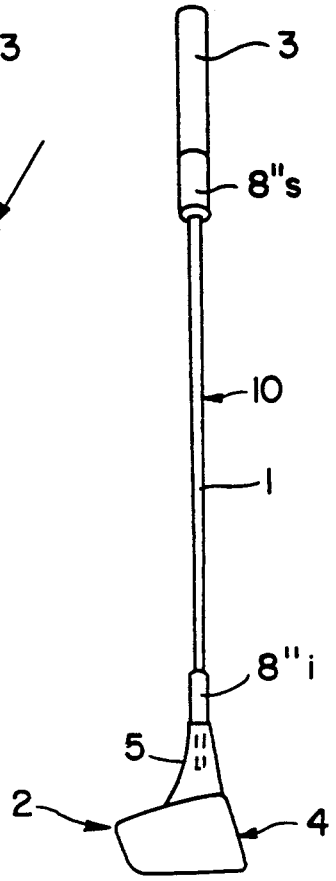

FIGS. 9 and 10 illustrate another possible variant, in which the shaft incorporates two damping devices **8''*i*, 8''*s*, i.e., a first, upper damping device 8''*s* positioned at the top of the shaft in the upper intermediate section 15 and a second, lower damping device 8''*i* positioned at the bottom of the shaft in the lower intermediate section 16**, so as to leave the median section of the shaft free.

FIGS. 1 to 10 show a "wood," but the damping device can, of course, be used on other types of clubs, such as irons and putters, while remaining within the scope of the invention. Only the vibration-frequency values are changed for these other types of clubs, but not the form of the modes of vibration. As a consequence, placement of the damping devices remains identical.

Figure 11:
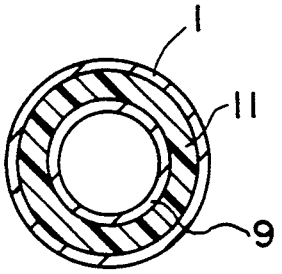
FIGS. 11, 12, and 13 illustrate a variant of the damping device.
Figure 12:
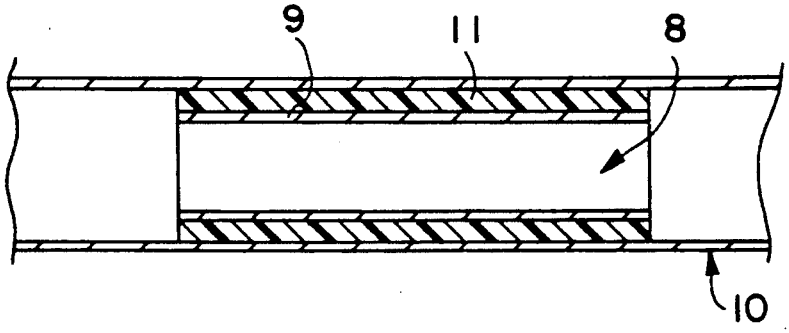
Figure 13:
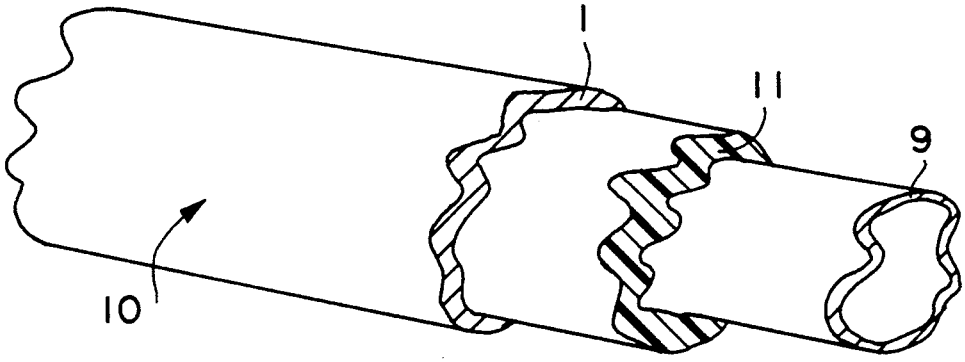
Figure 14:
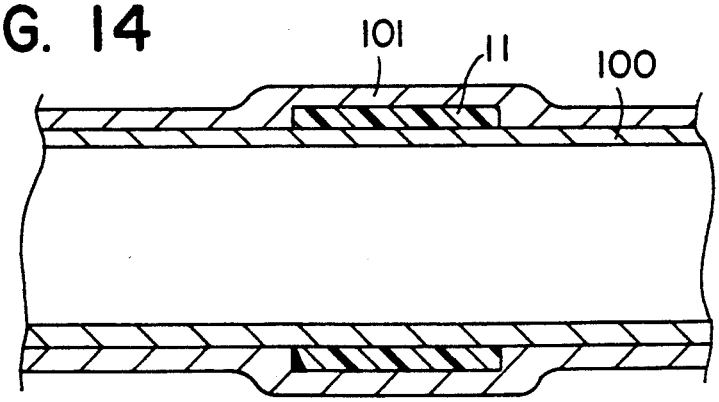
FIG. 14 illustrates another variant, in a view similar to FIG. 12.

According to the embodiments described hereinabove, the damping device 8, 8', 8'' is placed on the outer surface 10 of shaft but it could, while remaining on the outside of its structure, be, for example, positioned on the inner surface of the shaft, on the inside of the tube which forms it, as shown in FIGS. 11, 12, and 13: or else, it may be located within the shaft structure, as shown in FIG. 14. According to the variant in which the damping device 8 lies in the shaft structure itself, it is advantageously made of a composite material, and this damping device is placed, for example, between two layers of material 100, 101 during the manufacturing process, the device being such that the ring 9 made of rigid material is replaced by the upper layer 101.

FIGS. 15 illustrates one variant of the flexible connector 11 composed of several intermediate elements 110, 111, 112, 113, while the layer is tubular in the other embodiments.

FIG. 16 illustrates another variant, in which the elastic connector is produced from a series of several intermediate damping layers 114, 115 separated by a separation layer 102 made of a rigid material, thus forming a sandwich-shaped damping stack.

In all of the examples described above, the damping material may be of a different type, in particular of a rubber- or thermoplastic-type viscoelastic material, or of a fiber-based composite material having damping properties, such as aramid fiber-based composite materials.

Figure 5:
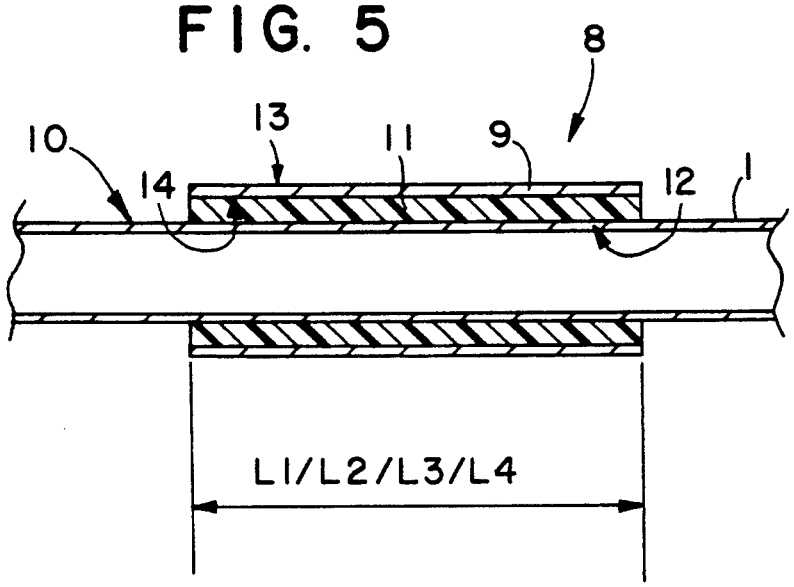
FIG. 5 is a longitudinal cross-section along line V—V in FIG. 4.
Figure 6:
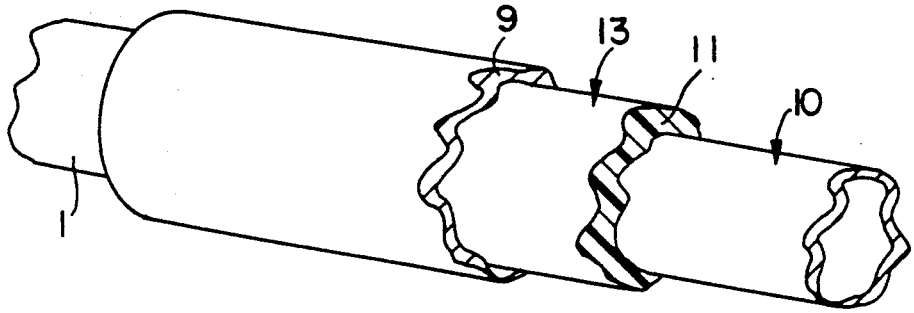
FIG. 6 is a perspective view, partly cut away showing the damping device in greater detail.

FIG. 17 is a view similar to FIG. 5 showing a damping device according to a variant, in which the device comprises only the elastic material layer 11 produced as a ring, the rigid ring 9 in the preceding embodiments having been eliminated.

Figure 19:
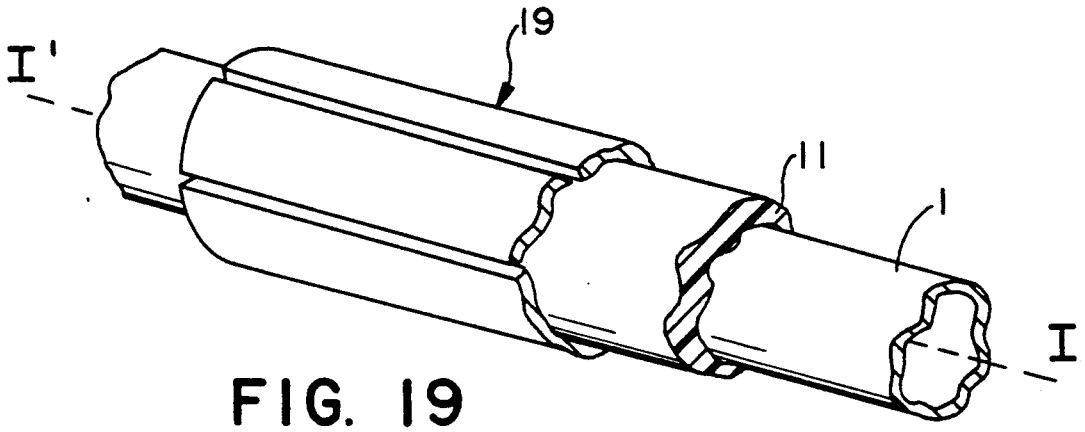
FIGS. 19 and 20 illustrate a variant of the damping device.
Figure 20:
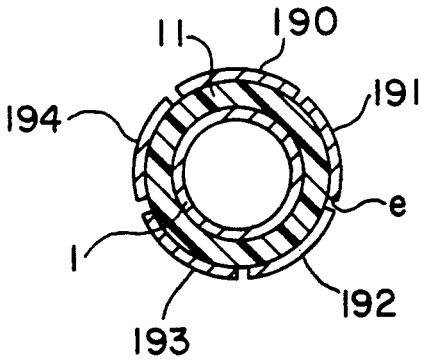

In FIG. 19, the outer rigid ring 19 is composed of several adjacent portions 190, 191, 192, 193 separated by a space, or spaces, extending longitudinally along the generating line. The number of portions may vary from approximately 2 to 6. The elastic material layer 11 arranged beneath the ring 19 is continuous and covers the upper surface of the shaft 1 around its entire circumference (FIG. 20).

Of course, the damping device may be positioned, not just below the grip and in contact with it, but moved away from it, as shown in FIG. 18, so as to leave a space "e." This arrangement may be adopted when the damping device is located at the bottom, below the neck of the head.

What is claimed is:

1. Golf club shaft formed by a unitary tubular structure having a total length (L) and comprising an upper part (70) adapted to receive a club grip and extended downward by an upper intermediate section (15), followed by a central section (10), then a lower intermediate section (16), and finally, a lower part (60) adapted for insertion in a club head, and comprising at least one distinct vibration damping device (8, 8', 8'') positioned in at least one of said upper and lower intermediate sections (15, 16) and constituted by at least one rigid layer joined to a surface of said shaft by means of an intermediate layer of viscoeleastic material.

2. Golf club shaft (1) as according to claim 1, said lower part (60) incorporating a head (2) and said upper part (70) incorporating a grip (3).

3. Golf club shaft according to claim 1, wherein said lower intermediate section (16) and said lower part (60) have a length equal to 20% of said total length (L) of said shaft.

4. Golf club shaft according to claim 1, comprising a damping device (8, **8''*i*) located in said lower intermediate section (16**).

5. Golf club shaft according to claim 1, wherein said damping device (8, 8', 8'') is structure (100), 101) of said shaft (1).

6. Golf club shaft according to claim 1, wherein said upper intermediate section (15) has a length L4 equal to 20% of said total length (L) of said shaft.

7. Golf club shaft according to claim 6, wherein said upper intermediate section (15) is positioned at a length (L2) from an upper end (7) of said shaft equal to 20% of said total length L of said shaft.

8. Golf club shaft according to claim 1, comprising a damping device (8, **8''*s*) positioned in said upper intermediate section (15**).

9. Golf club shaft according to claim 8, comprising an upper damping device (**8''*a*) located in said upper intermediate section (15) and a lower damping device (8''*i*) located in said lower intermediate section (16**).

10. Golf club shaft according to claim 8, wherein the length (L1) of said damping device is between 1 and 20% of the total length (L) of said shaft.

11. Golf club shaft according to claim 9, wherein the length (L2) of said damping device is between 1 and 20% of the total length (L) of said shaft.

12. Golf club shaft according to claim 1, wherein said damping device (8, 8', 8'') is positioned on an outside of said shaft structure (1).

13. Golf club shaft according to claim 12, wherein said damping device (8, 8', 8'') is positioned on an outer surface (10) of said shaft (1).

14. Golf club shaft according to claim 12, wherein said damping device (8, 8', 8'') is placed on an internal surface of an inside of said shaft (1).

15. Golf club shaft according to claim 1, wherein said damping device (8, 8', 8'') is constituted by a ring (11) made of a flexible material.

16. Golf club shaft according to claim 15, wherein said ring (9) is attached to said club shaft (1) by means of an intermediate layer (11) made of a viscoelastic material.

17. Golf club shaft according to claim 16, wherein said intermediate layer (11) is made of a rubber or thermoplastic material.

18. Golf club shaft according to claim 16, wherein said intermediate layer (11) made of a flexible material is bonded both to said rigid ring (9) and to said club shaft (1).

19. Golf club shaft according to claim 18, wherein said intermediate layer (11) has a thickness "e2" of between 1 and 4 millimeters.

20. Golf club shaft according to claim 19, wherein said intermediate layer (11) made of a flexible material is tubular.

21. Golf club shaft according to claim 20 wherein said intermediate layer (11) made of a flexible material is constituted by several intermediate elements (110, 111, 112, 113).

22. Golf club shaft according to claim 1, wherein said damping device (8, 8', 8'') is constituted by a ring (9) made of a rigid material and attached to said golf club shaft (1) by a flexible connector (11).

23. Golf club shaft according to claim 22, wherein said intermediate layer (11) is made of aramid fibers having damping properties.

24. Golf club shaft according to claim 22, wherein said rigid outer ring (19) is composed of several adjacent portions (190, 191, 192, 193, 194) separated by longitudinally extending grooves (e).

25. Golf club shaft according to claim 22, wherein said rigid ring (9) is made of steel, aluminum, or a composite material.

26. Golf club shaft according to claim 25, wherein said rigid ring (9) has a thickness "e1" of between 0.3 and at least two millimeters.

* * * * *